United States Patent [19]

Brammer

[11] Patent Number: 4,722,391

[45] Date of Patent: Feb. 2, 1988

[54] WELLHEAD SYSTEM

[75] Inventor: Norman Brammer, Ventura, Calif.

[73] Assignee: Vetco Gray Inc., Houston, Tex.

[21] Appl. No.: 891,703

[22] Filed: Jul. 31, 1986

[51] Int. Cl.[4] ..... E21B 33/128

[52] U.S. Cl. ..... 166/195; 166/208

[58] Field of Search ..... 166/124, 195, 206, 208, 166/382, 387

[56] References Cited

U.S. PATENT DOCUMENTS

| | | | |
|---|---|---|---|
| 3,903,965 | 9/1975 | Ahlstone | 166/208 |
| 4,372,563 | 2/1983 | Diehl et al. | 166/124 |
| 4,521,040 | 6/1985 | Slyker et al. | 285/140 |
| 4,611,663 | 9/1986 | Goris et al. | 166/382 |

*Primary Examiner*—Stephen J. Novosad
*Assistant Examiner*—William P. Neuder
*Attorney, Agent, or Firm*—Joseph R. Dwyer

[57] ABSTRACT

A pack-off assembly for a wellhead system including a tapered pack-off mounted on a pack-off nut (22) which has multi-start threads (40) for engaging similar mating multi-start threads (26) on a casing hanger (C). The casing hanger (C) is provided with a taper (20) which faces the surrounding cylindrical wall (16) of the wellhead (W) thus providing a tapered annulus (14). The pack-off, being tapered, is moved into the tapered annulus (14) by rotation of the pack-off nut (22) where the pack-off engages an abutment (30) and is compressed and expanded into sealing engagement with the internal (16) and external surfaces (20) on the wellhead (W) and casing hanger (C). In one embodiment, the multi-start threads (40, 26) on the running nut (22) and casing hanger (C) are tapered buttress threads and, in a second embodiment, the multi-start threads (**40*a*, 26*a***) on the running nut 22 and casing hanger (C) are cylindrical square threads.

This pack-off assembly is characterized as having better sealing capabilities, misalignment accommodation, minimum travel of the pack-off during setting, and ease of retrieval.

9 Claims, 5 Drawing Figures

WELLHEAD SYSTEM

RELATED INVENTIONS

The U.S. applications for Letters Patent of N. Brammer, one entitled "Wellhead Pack-off", Ser. No. 891,705, now U.S. Pat. No. 4,720,481, and another entitled "Weight/Pressure Set Pack-off for Subsea Wellhead Systems" Ser. No. 891,704, now U.S. Pat. No. 4,714,111, both filed even date herewith.

BACKGROUND OF THE INVENTION

This invention relates to wellhead systems and is specifically directed to seal assemblies, often referred to as pack-off assemblies, for sealing the annular space, often referred to as an annulus or gland, between a wellhead casing hanger and the surrounding cylindrical wall of a wellhead.

The U.S. Pat. No. 3,468,558 which issued as early as 1969, and later patents such as U.S. Pat. No. 3,871,449 explain the operation and purpose of pack-off assemblies as well as the various ways of running and setting the pack-off, i.e., sealing the annulus.

These patents also show different types of pack-offs for these pack-off assemblies and U.S. Pat. Nos. 3,797,864 of Hines and Ortolon and 4,521,040 of Slyker and Pettit illustrate more recent pack-offs which comprise an elastomeric ring interposed between two metallic seal rings with each metallic seal ring having a pair of lips extending toward the elastomeric material. Upon compression of the elastomeric material, the lips are forced outwardly towards the surrounding walls to thus seal the annulus with both the elastomeric material and metal.

It is an object of this invention to improve such prior art pack-off assemblies by providing such pack-off assemblies with better sealing capabilities, more accommodation to misalignment, minimum travel of the pack-off during setting, and ease of retrieval of the pack-off. Other advantages of this invention will be mentioned after the Summary, infra.

SUMMARY OF THE INVENTION

The improvement in pack-off assemblies which meets the foregoing object comprises a tapered pack-off mounted on a pack-off nut, which has multi-start threads for engaging similar mating multi-start threads on a casing hanger (inner tubular member). The casing hanger external surface is provided with a taper which faces the surrounding internal cylindrical wall of the wellhead (outer tubular member) thus providing a tapered annulus. The pack-off itself being tapered, is moved into the tapered annulus by rotation of the pack-off nut where the pack-off engages an abutment and is compressed and expanded into sealing relationship with the internal and external surfaces on the wellhead and casing hanger, respectively. The pack-off has an elastomeric ring between metallic seal rings with lips which are pressed against the internal and external surfaces by the compression of the elastomeric material providing both a metal-to-metal seal and an elastomeric seal.

In one embodiment, the multi-start threads on the running nut and casing hanger are tapered buttress threads, and in a second embodiment, the multi-start threads on the running nut and casing hanger are cylindrical square threads. As will be apparent to those skilled in the art from a study of the drawings and the detailed description hereinafter, the following advantages ensue:

A. The combination of a tapered annulus and an abutment against which the pack-off reacts improves the retrievability characteristics of the pack-off over the prior art where only a tapered annulus is used.

B. Utilizing the tapered pack-off in combination with the tapered annulus (a) permits pressure energization, (b) permits preloading of the inner metal lips against the tapered wall, (c) the wedging action improves the setting of the outer lips, (d) improves preloading sealing efficiency in the primary sealing direction, that is, from above, (e) improves the resistance to extrusion of the elastomeric material during make-up, i.e., eliminating pinching of the elastomeric material by the metallic lips, (f) minimizes any tendency to hydraulic lock due to the reduced swept volume, (g) tolerates axial and angular misalignment, (h) provides a mechanical advantage in energizing the lower part of the pack-off and lips (i) provides a minimum of travel of the pack-off nut at high torque.

How the above advantages are met will be discussed in the Detailed Description hereinafter.

In the first embodiment of the invention where tapered multi-start threads are used on the pack-off and casing hanger, there is provided a tapered less-than-one-turn make-up, and the lead necessary to energize the pack-off will determine the number of starts and pitch necessary. This embodiment also provides maximum alignment capability due to the alignment, self-stabbing characteristics of the tapered threads.

In the second embodiment of the invention where the threads are cylindrical on the pack-off nut and casing hanger, the advantage of multi-start threads permits easier stabbing, more travel with the thread engaged, and allows an operator to count the number of turns during setting.

DETAILED DESCRIPTION

Figure 1:
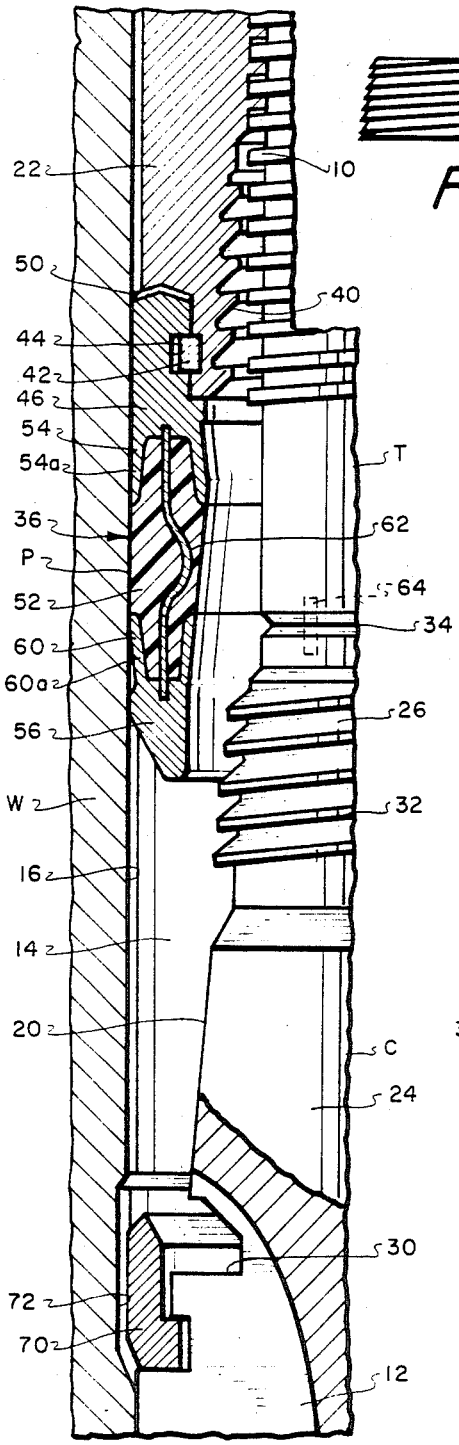
FIG. 1 is a partial cross-sectional elevational view of a wellhead system illustrating a pack-off seal assembly having a tapered running nut with multi-start threads and supporting a tapered pack-off, constructed in accordance with the teachings of this invention above the tapered annulus.
Figure 2:
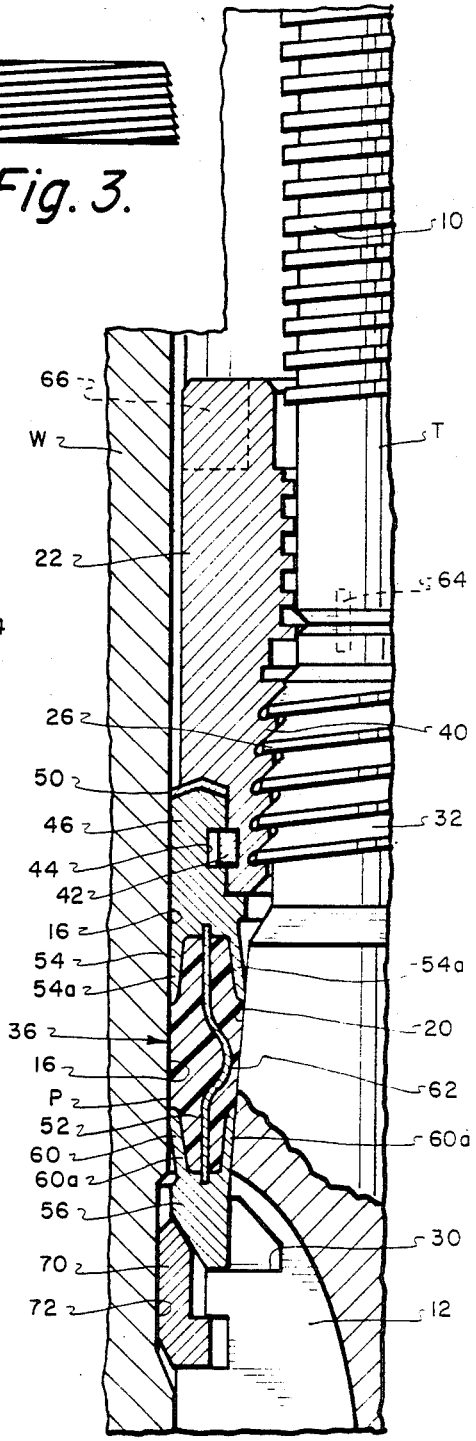
FIG. 2 is a view similar to FIG. 1, but showing the tapered running nut threaded onto mating threads on the casing hanger and pack-off energized and set in the tapered annulus, thus sealing the latter.

In FIGS. 1 and 2 of the drawings, the invention is depicted already landed in a wellhead housing W (outer tubular member) with a casing hanger C (inner tubular member) and supported on a suitable outwardly facing seat or shoulder (not shown) in the bore of the wellhead housing W. Such a support for the casing hanger C in a wellhead housing is conventional and well known.

The casing hanger C and pack-off assembly P were assembled (made up) while on the vessel or platform, and lowered to the wellhead housing W on a running tool T which is conventionally connected to one end of a string of tubing, such as drill pipe. Whether or not the casing hanger C and the pack-off assembly P are lowered together or two trips to the wellhead are required, one for setting the casing hanger C and the other to lower the pack-off assembly P and perhaps a wear bushing, is not material to this invention. Also, the pack-off assembly P and running tool T are shown connected together in FIG. 1 for running by mating square threads 10 which are shown only as one way in which the two may be connected.

In the position shown in FIG. 1, circulating and cementing operations can be conducted in the usual manner through circulating passages 12 and annulus or space (gland) 14 between the cylindrical inner wall, or bore, 16 of the wellhead housing W and the opposing wall 20 of the casing hanger C. After completion of the cementing operations, the annulus 14 is sealed by the pack-off assembly P. This is accomplished by rotation of pack-off nut 22 of the pack-off assembly P. As stated above, this invention is an improvement over the prior art apparatus for accomplishing this seal. How this seal is accomplished will be described, infra.

The depicted casing hanger C comprises a main body section 24 integral with an upper section 26 and provided with a cylindrical inner bore, the circulating passages 12 and a pack-off actuating shoulder (abutment) 30. Not shown are threads at the lower end of the casing hanger to support threaded casing in the well in the conventional and known manner.

The casing hanger C differs from the prior art casing hangers in that the upper section 26 is conically tapered upwardly and provided with multi-start threads 32 immediately below the mouth 34 of the casing hanger C. Also, the wall 20 is also conically tapered in the same direction as the threaded upper section 26. The wall 20 thus defines the annulus 14 as tapered with its widest opening at the top.

Figure 3:
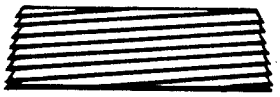
FIG. 3 is a schematic illustration of a multi-start thread of the prior art which is embodied in the invention.

The multi-start threads 32 of the type formed on the casing hanger C are shown and described in the European Application No. 8401875.4 of Philippe C. Nobileau. This application was published May 2, 1985 (Publication No. 0 139 565) and in this European application the threads are illustrated on a pin and box connector. (FIG. 3 herein is a reproduction of one of the illustrations in the application.) As explained in this European application, after stabbing the pin and box, full make-up of the pin and box threads is accomplished by a rotation of a fraction of a turn, with the entire length of the threads fully engaged over the entire periphery of their interlocking surfaces since each thread extends over more than one turn. The amount of rotation depends inversely on the number of thread starts. Since the amount of travel of the running nut to set the pack-off may vary, the number of thread starts and thread pitch may be selected accordingly.

The pack-off assembly P includes the pack-off drive nut 22 and a pack-off or seal portion 36 connected to and supported by the pack-off drive nut 22. The pack-off drive nut 22 is cylindrical and is conically tapered at its inner lower end and provided with mating multi-start threads 40 to mate with the multi-start threads 32 on the casing hanger C. The multi-start mating threads 32, 40 may also be provided with a reverse taper at their mating faces to help eliminate the tendency for the threads to be forced out of engagement with each other under load. Such threads are referred to as wicker threads and are normally on a split ring also called a wicker ring. The pack-off 36 is of the type shown and more fully described in the U.S. Pat. No. 3,797,874 and in the U.S. Pat. No. 4,521,040, supra, and can be seen to include a swivel connection accomplished by a split retainer ring 42 mounted in complementary grooves 44 in a metallic support ring 46 and in the pack-off drive nut 22. A thrust bearing area 50 between the pack-off drive nut 22 and the support ring 46 permits rotation of the pack-off drive nut 22 without rotating the support ring 46. In the embodiment disclosed, the lower end of the support ring 46 engages and supports the upper end of a cylindrical elastomeric deformable packing ring 52 by a downwardly opening dovetail connection 54 with lips **54*a*. A lower abutment metallic ring 56 is connected to the packing ring 52 by an upwardly opening dovetail connection 60. The support ring 46 and its dovetail connection 54 and the lower abutment ring 56 with its dovetail connection 60 with lips 60*a* also function as metal-to-metal seals when the pack-off is set. Because of their function, these rings and dovetail connections are also referred to as metallic seal rings and sealing lips, respectively. Also, this pack-off 36 is provided with a relatively thin curved cylindrical band 62** provided with long narrow slots (not shown) which form a plurality of vertical bands (also not shown) extending between the two metallic seal rings. The metallic band is such that it does not interfere with the deformability of the elastomeric material but provides a mechanical connection between the upper and lower support and abutment rings and thus provide the pack-off assembly P with retrievable characteristics. A more complete explanation of the pack-off assembly with the retrievable characteristics is described and claimed in the U.S. patent application of Martin B. Jansen and John Pettit, Ser. No. 727,492 filed Apr. 26, 1985 entitled Retrievable Pack-Off to which reference may be made if desired.

This pack-off 36 differs, however, from the above mentioned prior art pack-offs in that the upper support ring 46 is wider than the lower abutment ring 56 such that the relationship between the two is complementary to the annulus to be sealed.

During running, the pack-off seal assembly is supported on the running tool T by the interengaging threads 10. Upon landing, rotation of the running tool T will lower the pack-off assembly until it disengages the interengaging threads 10 and the multi-start threads 40 and 26 will interengage. Suitable means, such as pins 64 (one shown in phantom) inhibit relative rotation between the casing hanger C and the running tool T. Suitable means, such as a sleeve (not shown) with lugs, rotatable on running tool T, engaging lugs or slots 66 (one shown only in phantom in FIG. 2) are used to rotate the running nut 22. A partial rotation of the running nut will fully set the pack-off P causing the abutment ring 56 to engage the abutment by reason of the use of the multi-start threads and conical taper thereof which permits stabbing of the running nut over the casing hanger before the threads engage. The elastomeric ring is thus compressed and the upper and lower lips 54 and 60 form metal-to-metal seals and anti-extrusion barriers. The supporting ring also engages a split ring 70 which is held on the casing hanger C and urges the split ring 70 into a groove 72 in the wellhead in order to lock the casing hanger C in the wellhead as more clearly shown in FIG. 2. At this time the pack-off P is considered set. For a more complete explanation of how the lips 54 and 60 react during movement of the pack-off downwardly into the annulus, reference is made to the Slyker and Pettit patent, supra.

As pointed out above, with the use of the multi-start threads and the use of the tapered annulus and pack-off accomplishes the advantages set forth above. The tapered annulus, tapered pack-off assembly and abutment together enhances the sealing characteristic of the pack-off. The tapered wall 20 provides a radial force on the inner lips 54*a* and 60*a* of the upper and lower dovetail connection, thus reploading the latter, provides a wedging action against the elastomeric material and lips and eliminates any pinching of the elastomeric material by the lips 54*a* and 60*a*. The tapered annulus allows the pack-off to be out of contact with the annulus walls until almost the very last part of the travel of the pack-off assembly downward until it engages the abutment 30 thus providing a mechanical advantage in that not until the very last that high torque is required to engage the pack-off. Also the abutment functions to prevent the pack-off from being irretrievably wedged in the annulus. Too, the engagement of the pack-off against an abutment ring in a tapered annulus and the tapered multi-start threads permits the pack-off assembly to be retrieved with less than one turn of the running nut in the event a seal is not fully effected.

Figure 4:
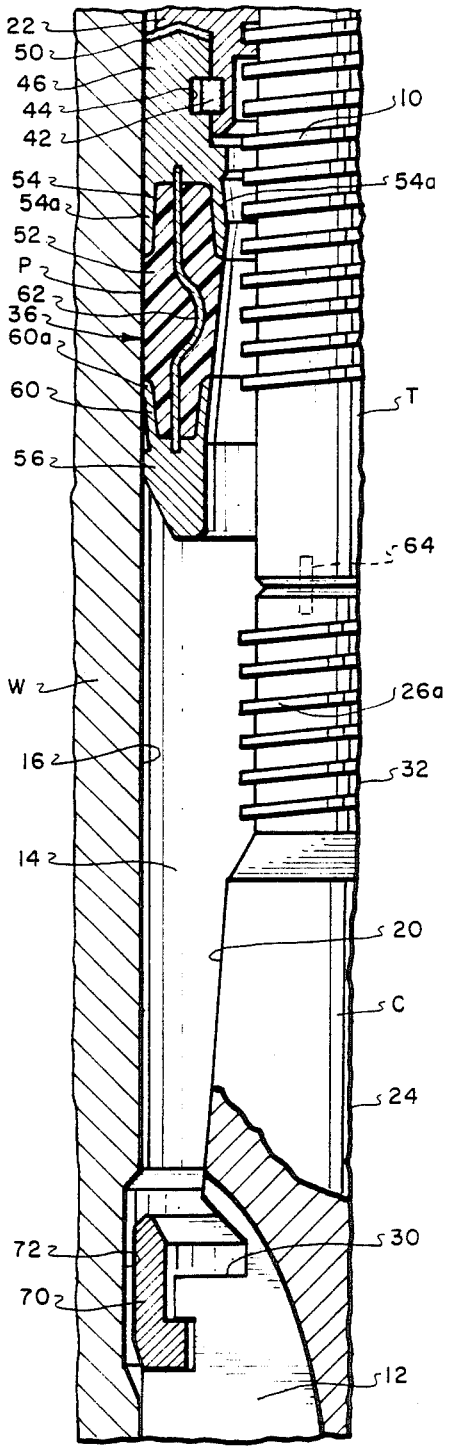
FIG. 4 is a second embodiment of the invention in which the multi-start threads on the running nut and casing hanger are square and cylindrical.
Figure 5:
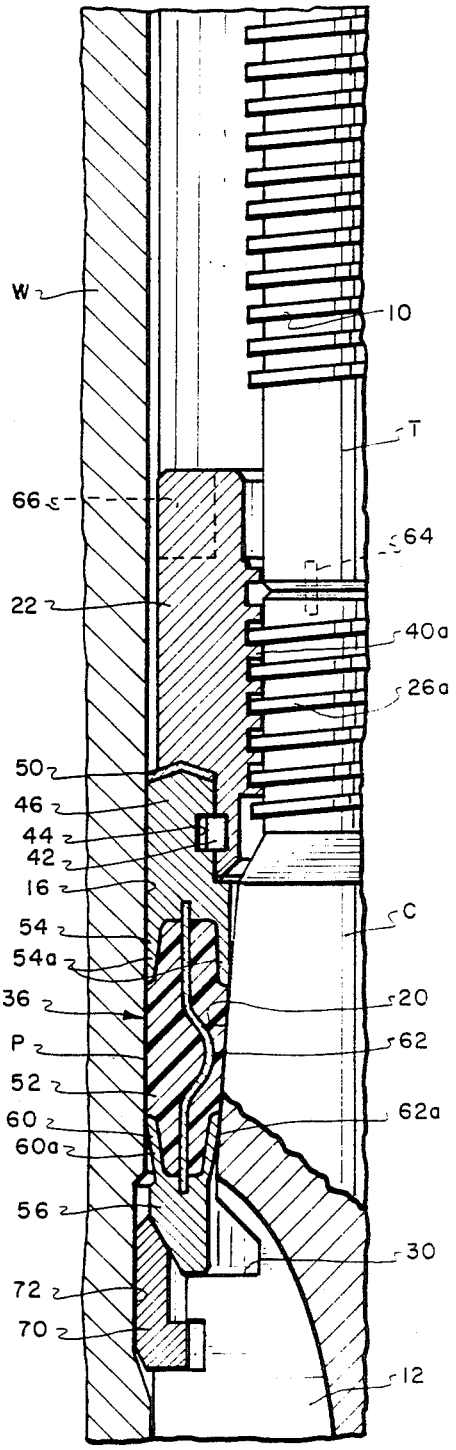
FIG. 5 illustrates the assembly of FIG. 4 in set and sealed condition.

Turning now to FIGS. 4 and 5, where the second embodiment of the invention is disclosed, it can be seen that the difference between the two embodiments lies in the multi-start threads on the running nut 22 and casing hanger C. In this embodiment, the multi-start threads 26*a* and 40*a* are cylindrical (parallel), otherwise, the wellhead system is identical to the prior embodiment. To denote this similarity and difference between the two embodiments, the same reference numerals are used to denote the same components and for the multi-start threads reference numerals 26*a* and 40*a* are used. This simplifies the description of the second embodiment. The parallel threads are preferably two start threads for easier stabbing and allowance of more travel with thread engagement.

What is claimed is:

1. A well seal assembly for sealing between the interior surface of an outer tubular member and the exterior of an inner tubular member, said inner tubular member having a tapered surface spaced from and facing the interior surface of said outer tubular member, comprising;

a seal assembly including, an upper metallic seal ring, a lower metallic seal ring, an elastomeric seal ring interposed between said metallic seal rings, the upper metallic seal ring being wider than the lower metallic seal ring to form a tapered seal assembly and to conform to the taper of said inner tubular member, said metallic seal rings and elastomeric seal ring together forming a packing seal, one of said tubular members having an abutment means, and means for shifting said seal assembly toward and into engagement with said abutment means and to compress said packing seal therebetween and expand the packing seal into sealing engagement with said internal and external surfaces, said means for shifting said seal assembly includes interengaging multi-start threads on said seal assembly and on said inner tubular member which move said seal assembly in response to rotation thereof, said taper on said inner tubular member and said taper on said seal assembly providing a mechanical advantage in that said seal assembly is out of contact with the surfaces of said inner and outer tubular members until the lower metallic ring engages said abutment means, at which time said abutment means provides a radial expansion of said elastomeric seal ring expanding said upper and lower metallic seal rings against said surfaces, said movement of said seal assembly being accomplished in less than one turn of said seal assembly after said multi-start threads interengage, said multi-start threads, said abutment means and said taper on said inner tubular member combining to facilitate retrieval of said seal assembly, if necessary.

2. The well seal assembly as claimed in claim 1 wherein said multi-start threads are conically formed.

3. The well seal assembly as claimed in claim 2 wherein said upper and lower metallic seal rings are connected by a metallic ring embedded in said elastomeric material to facilitate retrieval of said seal assembly.

4. The well seal assembly as claimed in claim 1 wherein said multi-start threads are cylindrical.

5. The well seal assembly as claimed in claim 4 wherein said upper and lower metallic seal rings are connected by a metallic ring embedded in said elastomeric material to facilitate retrieval of said seal assembly.

6. In combination:

a vertical outer body member having an internal cylindrical sealing surface;

a vertical inner body member within said outer body member and having an external conical sealing surface;

said inner member being radially spaced from said outer member to define a tapered annular space between said sealing surfaces;

one of said body members having an abutment;

supporting means movable longitudinally toward said abutment;

a packing assembly carried by said supporting means, said packing assembly comprising a tapered packing sleeve of elastomeric material, the taper of said packing sleeve conforming to the tapered annular space, an upper metallic ring carried by said supporting means, means securing said ring directly to the upper end portion of said packing sleeve, a lower metallic ring narrower in width than said upper ring, means securing said lower ring directly to the lower end portion of said packing sleeve, said lower ring being supported in part by said packing sleeve, each of said rings including inner and outer lip seals extending circumferentially around the inner and outer surfaces of said packing sleeve, said inner and outer lip seals of said rings confronting each other, said packing sleeve and inner and outer lip seals of both rings being adapted to be disposed in said annular space between said sealing surfaces; and means for moving said supporting means and packing assembly carried thereby longitudinally upon rotation of said supporting means toward said abutment to engage said lower ring with said abutment and then shift said upper ring toward said lower ring to shorten and compress said packing sleeve therebetween and expand said sleeve into sealing engagement with said internal and external surfaces and to cause said packing sleeve to expand said inner and outer lip seals of both rings into bridging and metallic sealing engagement with said external and internal surfaces, respectively, said supporting means including multi-start threads and said inner body member including multi-start threads which engage said threads on said supporting means when said supporting means is rotated, said tapered packing sleeve being out of contact with said sealing surfaces until said lower metallic ring engages said abutment at which time continued rotation of said supporting means provides radial expansion of said elastomeric material and upper and lower metallic rings against said sealing surfaces, said movement of supporting means and packing assembly being accomplished in less than one turn of said supporting means.

7. The combination claimed in claim 6 wherein said upper and lower rings are mechanically connected by a flexible ring embedded in said elastomeric material.

8. The combination as claimed in claim 7 wherein said multi-start threads are complementary and conically tapered to allow said support means to stab over said inner body before said threads interengage to move said packing assembly into engagement with said abutment means.

9. The combination claimed in claim 7 wherein said multi-start threads are complementary and cylindrical.

* * * * *